United States Patent [19]

Case

[11] 4,333,591

[45] Jun. 8, 1982

[54] BABY BACKPACK SACK

[76] Inventor: Dorothy S. Case, 2101 Forest Park Dr., Anchorage, Ak. 99503

[21] Appl. No.: 196,287

[22] Filed: Oct. 14, 1980

[51] Int. Cl.[3] ..... A47D 13/02

[52] U.S. Cl. ..... 224/160; 224/161; 224/210

[58] Field of Search ..... 224/160, 153, 155, 156, 224/158, 159, 161, 209, 210, 213, 153

[56] References Cited

U.S. PATENT DOCUMENTS

| | | | |
|---|---|---|---|
| D. 132,469 | 5/1942 | Murphy . | |
| D. 139,071 | 10/1944 | Frazee | D92/2 |
| 1,940,224 | 12/1933 | Munro | 5/343 |
| 2,008,919 | 7/1935 | Milkes | 5/343 |
| 2,131,248 | 9/1938 | Astrove | 2/84 |
| 2,421,244 | 5/1947 | Daiber | 224/25 |
| 2,628,358 | 2/1953 | Neils | 2/69.5 |
| 2,836,334 | 5/1958 | Davis | 224/210 X |
| 3,229,873 | 1/1966 | Hershman | 224/160 |
| 3,481,517 | 2/1969 | Aukerman | 224/6 |
| 3,799,414 | 3/1974 | Fiffer | 224/161 |
| 3,871,562 | 3/1975 | Grenier | 224/160 |
| 4,009,808 | 3/1977 | Sharp | 224/6 |
| 4,074,839 | 2/1978 | Wood et al. | 224/8 R |

FOREIGN PATENT DOCUMENTS

| | | | |
|---|---|---|---|
| 71110 | 6/1950 | Denmark | 224/159 |
| 61077 | 7/1939 | Norway . | |

*Primary Examiner*—Steven M. Pollard

*Attorney, Agent, or Firm*—Burns, Doane, Swecker & Mathis

[57] ABSTRACT

A baby backpack sack adapted for use with a baby backpack carrier is disclosed formed by first and second side panels and an end panel which form a partially closed container. The panels are joined together by longitudinal seams arranged generally in the shape of an inverted Y. The arrangement of the longitudinal seams permits greater expansion of a lower end of the container to accommodate a wider range of baby backpack carriers, to provide additional room for carrying other items in the baby backpack sack with the baby and especially to accommodate a collapsible stand of the baby backpack carrier. The baby backpack sack preferably includes a plurality of pockets on an outside surface of the container for carrying items such as bottles and diapers. Still further, the container includes an access slot on an outside surface of the container for facilitating access to the interior of the container when a baby is placed therein. Still further, the baby backpack sack includes a hood with a drawstring which is adjustable and has a wide collar which when used with the baby backpack sack provides near total containment.

15 Claims, 5 Drawing Figures

BABY BACKPACK SACK

BACKGROUND AND SUMMARY OF THE PRESENT INVENTION

The present invention relates generally to devices for carrying and protecting babies. More particularly, the present invention relates to a device intended for use with a baby backpack carrier for protecting a baby.

Backpack carriers for babies are well known. Generally, such carriers include a pair of shoulder straps with a seat or other suitable arrangement suspended by the shoulder straps for securely holding a baby within the carrier. Some carriers in addition include a stand such that the carrier can be removed from the wearer's back and placed on the ground in an upright position to provide a seat or chair for the baby. However, such carriers have the disadvantage that during cold or damp weather, the baby is substantially unprotected from the elements. Consequently, the baby must be wrapped in additional blankets or not taken along during such foul weather. In addition, the usual baby backpack carrier does not provide a storage compartment having sufficient room for carrying various items such as bottles, diapers, etc.

Various devices have been proposed for transporting a baby within a partially closed container. One known device comprises a knapsack bunting which includes a pair of shoulder straps and a waist strap for facilitating a carrying of a baby in the bunting. Such a device is illustrated in U.S. Pat. No. De. 132,469 issued on May 19, 1942 to Murphy. The Murphy bunting is not disclosed, however, for use with a baby backpack carrier.

Another device for transporting a baby is disclosed in U.S. Pat. No. 4,009,808 issued on Mar. 1, 1977 to Sharp. The carrier disclosed in the Sharp patent (like the bunting of the Murphy patent) comprises a flexible casing which includes both a pair of shoulder straps to be worn by the user and an adjustable waist band. A seat member is arranged within the casing and openings are provided for the infant's legs. Further devices of this general type are disclosed in U.S. Pat. No. 3,481,517 issued on Dec. 2, 1969 to Aukerman, U.S. Pat. No. 2,628,358 issued on Feb. 17, 1953 to Neils and Norwegian Pat. No. 61,077 issued on July 3, 1939.

Sleeping or garment bags for infants, generally not adapted for use with a backpack carrier, are also known. Representative bags of this type are disclosed in U.S. Pat. No. 1,940,224 issued on Dec. 19, 1933 to Munro, U.S. Pat. No. 2,008,919 issued on July 23, 1935 to Milkes and U.S. Pat. No. De. 139,071 issued on Oct. 10, 1944 to Frazee.

Various devices for carrying a backpack having a selectively closable container have also been proposed. One such device comprises a backpack removably enclosing a frame. The backpack has a sack portion and an envelope which encloses a tubular frame member. Such a device is disclosed in U.S. Pat. No. 4,074,839 issued on Feb. 21, 1978 to Wood et al. A device of this type, however, is not adapted for carrying a baby on a backpack carrier within a protective casing.

Another known backpack device includes a packboard frame which is collapsable with an arrangement for receiving straps from a knapsack-like container. A device of this type is disclosed in U.S. Pat. No. 2,421,244 issued on May 27, 1947 to Daiber.

Finally, an infant's garment comprising a hood is known from U.S. Pat. No. 2,131,248 issued on Sept. 27, 1938 to Astrove.

Accordingly, it is an object of the present invention to provide a backpack sack or container for a baby which encloses the baby sufficiently to keep the baby warm and dry during foul weather.

Another object of the present invention is to provide a backpack sack for a baby which is both simple in construction and adapted to fit over a large number of standard baby backpack carriers for protecting a baby placed in the backpack carrier.

Still another object of the present invention is to provide a baby backpack sack which includes additional room or a storage compartment within the sack for carrying baby related items or items which the person carrying the baby desires.

Yet still another object of the present invention is to provide a baby backpack sack for use with a backpack carrier having a stand whereby the baby can be protected from the elements both while being carried and while the backpack carrier is arranged in an upright position.

These and other objects of the present invention are realized by a baby backpack sack according to the present invention having first and second side panels and a first end panel forming a partially closed container. An upper end of the sack (which end is normally open) includes an arrangement for selectively closing or sealing the upper end of the sack once the baby has been placed therein. The baby backpack sack preferably has an arrangement of slots or reinforcements for slots on a first side of the sack (near the bottom) with a relatively large slot being provided in the first side of the sack generally parallel with an end edge of the first side panel and arranged centrally near the upper end of the sack.

In a preferred embodiment of the present invention the slots (or reinforcements for slots) on the lower end of the first side are adapted for selectively receiving a lower portion of shoulder straps attached to a baby backpack carrier and the slot in the upper portion of the first side of the container is arranged for receiving an upper portion of the shoulder straps attached to the baby backpack carrier.

In the preferred embodiment, the backpack sack comprises a first generally rectangular panel having first and second side edges and an upper edge and a lower edge. A second generally rectangular panel has a first side edge secured to the first side edge of the first panel (along a portion of the panels) and has a second side edge secured to the second side edge of the first panel (also along a portion of the panels). A third panel is secured to the first and second panels along the lower edges. The third panel is secured to the first and second side edges of the first and second panels so as to form a sack closed at the bottom and normally open at the top. Preferably, the first, second and third panels are formed of a single, continuous piece of flexible material with the first, second and third panels defined by first and second fold lines.

According to the preferred embodiment of the present invention, the baby backpack sack includes an access slot on the second side of the container for permitting access to the interior of the container. Still further, the preferred embodiment of the present invention includes a plurality of slots or reinforcements for slots on the first side of the sack arranged for selectively receiving a waist strap of a baby backpack carrier (if one is provided or desired).

In the preferred embodiment, the container is comprised of a single continuous piece of material which is folded along fold lines and secured along longitudinal edges such that each longitudinal edge is generally in the form of an inverted Y. At least one selectively closable pocket is preferably arranged on the second side of the container for carrying items such as bottles and diapers with at least one access slot permitting access to the interior of the container being arranged within one of the selectively closable pockets. Still further, the slot adapted for receiving an upper portion of the shoulder straps of the baby backpack carrier includes releasable fasteners which selectively divide the slot approximately in thirds to permit attachment of either parallel shoulder straps or crossed shoulder straps.

BRIEF DESCRIPTION OF THE DRAWINGS

A preferred embodiment of a baby backpack sack, according to the present invention, will be described with reference to the accompanying drawings wherein like members bear like reference numerals and wherein.

DETAILED DESCRIPTION OF THE PREFERRED EMBODIMENT

Figure 1:
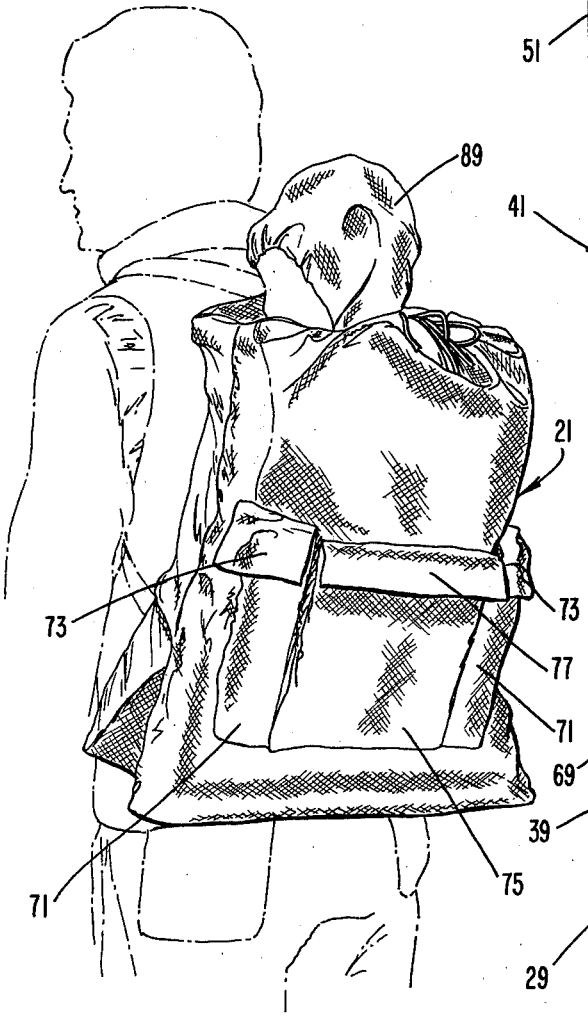
FIG. 1 is a perspective view of a preferred embodiment of a baby backpack sack according to the present invention enclosing a backpack carrier being carried on a person's back.

With reference to FIG. 1, a baby backpack sack 21 according to the present invention is arranged over a suitable, conventional baby backpack carrier in a manner to be described below, and is arranged to snugly enclose a baby therein.

Figure 2:
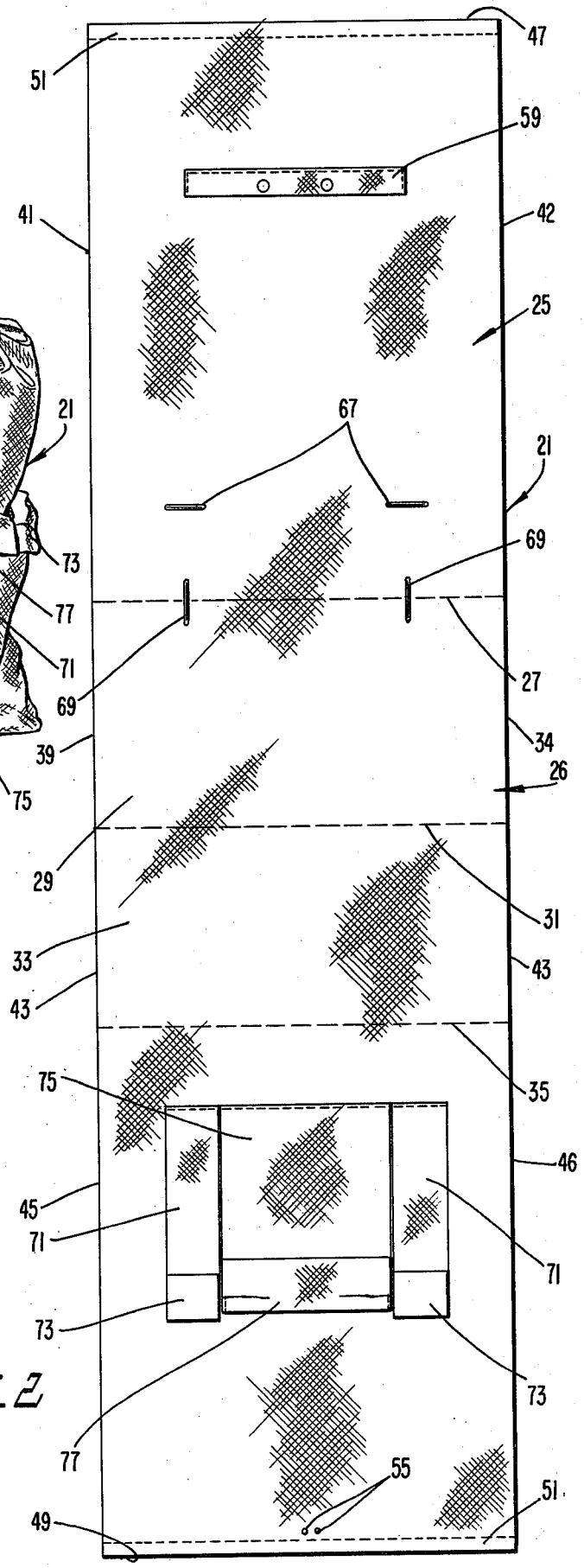
FIG. 2 is a view of the outside surface of the baby backpack sack according to the present invention with the major seams unstitched.

With particular reference to FIG. 2, the baby backpack sack 21 is preferably comprised of a single piece of readily flexible, elongate material. The material is divided into a first panel 25 which forms a back side of the baby backpack sack 21. The first panel 25 is normally adjacent the wearer's back when in use.

A second panel 26 is adjacent and connected to the first panel 25 along a first fold line 27. The first fold line 27 may, of course, be replaced by a seam if the panels 25, 26 are not formed of a continuous material. The second panel 26 is divided into first and second portions 29, 33 provided on either side of a second fold line 31. The second and third portions of the panel 26 together from a closed end of the completed baby backpack sack 21. The second panel 26 is attached to an end edge of a third panel 37 along a fold line 35 with the third panel forming another side of the baby backpack sack (which side normally faces away from the wearer).

Figure 3:
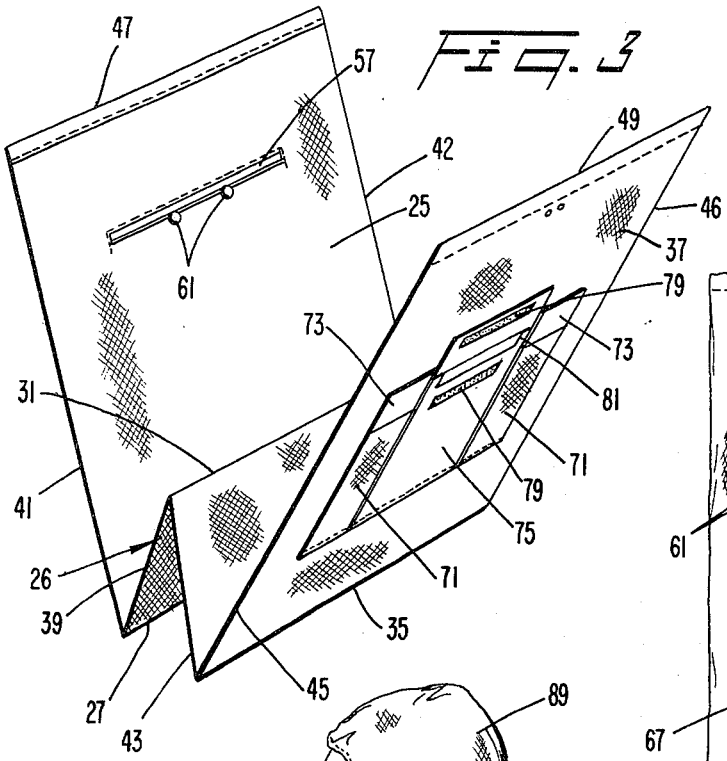
FIG. 3 is a perspective view of the (unstitched) baby backpack sack of FIG. 2 (shown folded along major fold lines)

With reference to FIG. 3, when the elongated material 23 is folded along the fold lines 27, 31, 35 (indicated in dashed lines in FIG. 2) to form the baby backpack sack 21, an end edge 39 of the second panel 26 is adjacent a portion of a longitudinal edge 41 of the first panel 25. A second edge 43 of the second panel 26 is adjacent a portion of a longitudinal edge 45 of the third panel 37. The remaining portions of the longitudinal edges 41, 45 of the first and third panels 25, 37 respectively are likewise adjacent to one another from the junction of the edges 39, 43 on the second panel 26 respectively up to an upper end of the first and third panels 25, 37. The adjacent edges are then stitched together to define a first major seam 70 having an inverted Y configuration. (See FIG. 5).

A similar attachment is accomplished along the other longitudinal edges 42 and 46 of the first and third panels 25, 37 respectively with the edges 34, 43 of the second panel (see FIG. 2). The edges are likewise stitched to define a second major seam 70 also having an inverted Y configuration. In this way, a partially closed container having an open upper end along upper edges 47, 49 of the first and third panels 25, 37 respectively is provided.

In other words, the side edges of the folded material 23 (see FIG. 3) are joined to one another to form the baby backpack sack 21 when completed by the major seams 70 having the shape of an inverted Y (FIG. 5) having a first seam portion extending from the open end of the baby backpack sack 21 along the respective longitudinal edge of the first and third panels and second and third seam portions joining one another at a lower end of the first seam and extending separately to the lower end edges of the first and third panels 25, 37 respectively.

Figure 4:
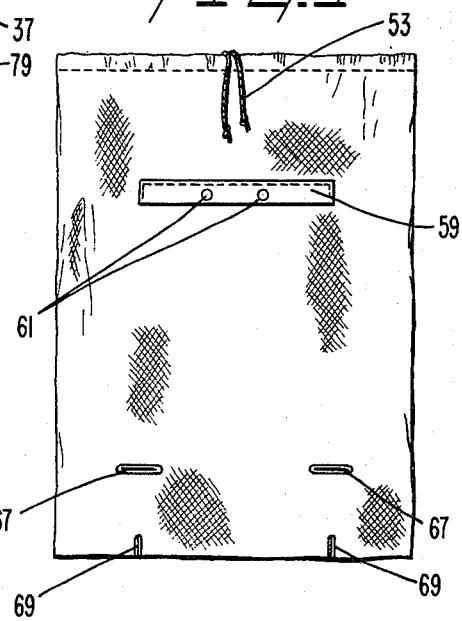
FIG. 4 is a back view of the baby backpack sack of FIG. 1.

Upper edge areas 51 (see FIG. 2) are provided on the upper edges 47, 49 of the first and third panels 25, 37 respectively which edge areas 51 are arranged to be folded toward the interior of the sack or container after securement of the longitudinal edges of the baby backpack sack 21. A drawstring 53 (see FIG. 4) is arranged within the folded edge areas 51 and extends through eyelets 55 (see FIG. 2) provided adjacent the edge area 51 on the third panel 37 prior to securement of the edge areas 51 to the respective panel along the upper edges 47, 49 of the first and third panels 25, 37 respectively. The drawstring 53 provides an arrangement for selectively closing the normally open end of the baby backpack sack 21 about the baby.

The first panel 25 is provided with a longitudinal slot 57 (see FIG. 3) which is adapted to receive an upper portion of shoulder straps of a baby backpack carrier as will be described in more detail below. A flap 59 arranged to cover the slot 57 (see FIG. 2) is secured along an upper side and each end thereof to the outside of the first panel 25. A pair of releasable fasteners 61, e.g. snaps, are provided to secure a lower side of the flap 59 to the first panel 25. The releasable fasteners 61 divide the flap 59 substantially in thirds, i.e., three separate openings are provided under the flap 59 into the interior of the backpack sack 21 and through the common slot 57.

By providing the elongated slot 57 with the flap 59 and the releasable fasteners 61, the baby backpack sack 21 of the present invention can be adapted for use with various different configurations of shoulder straps dependent upon the particular baby backpack carrier to be used in conjunction with the baby backpack sack 21 of the present invention. If the particular baby backpack carrier employed has two shoulder straps running generally parallel to one another at an upper end of the carrier, then the two straps exit through the openings of outer thirds 63 of the flap 59. If, on the other hand, the shoulder straps at the upper end of the backpack carrier are arranged in a criss-crossed manner, the two straps would exit through the slot 57 under the flap 59 between the two releasable fasteners 61 through the opening in a middle third 65 of the flap 59. The releasable fasteners 61 aid in preventing slippage of the shoulder straps within the slot 57. Further, by providing the fasteners 61 on the flap 59, the insertion and removal of the straps is greatly facilitated due to the wide opening of the slot 57 with the fasteners 61 detached. It should also be noted that the flap 59 prevents moisture and other material from falling through the slot 57 when the baby backpack sack 21 is in use.

Also arranged on the first panel 25 near the fold line 27 are a pair of reinforcements 67 for indicating the location of slots. In the preferred embodiment, each of the reinforcements 67 consists of reinforced stitching surrounding a small slit shaped piece of material. When it is desired to use the baby backpack sack 21, the material within the reinforced stitching can be easily cut by the user. Once opened, the slits provided within the reinforcements 67 are adapted to receive a lower portion of the shoulder straps of a backpack carrier.

A second pair of reinforcements 69 for slots are arranged at the fold line 27 of the first panel 25 and are arranged to be opened in the manner described above when a waist strap is provided on the backpack carrier to be employed or it is desired to add a waist strap to a preexisting backpack carrier for better support of the carrier and backpack sack 21. The reinforcements 69 are arranged generally perpendicularly to the first reinforcements 67 to more easily accommodate the waist strap of a backpack carrier.

In the preferred embodiment, the first portion 29 of the second panel 26 is slightly longer in length than the second portion 33 of the second panel 26. Likewise, the first panel 25 is preferably slightly longer in length than the third panel 37 so as to correspond to the increased length of the portion 29 of the second panel 26. By this arrangement, the portion of the baby backpack case 21 which is adjacent the wearer's back is more readily adaptable to different configurations of shoulder straps and various lengths of suitable, conventional frames of the baby backpack carrier. Also, the second pair of reinforcements 69 preferably extends partially into the second panel 26 to more easily accomodate a waist strap at a lower end of a carrier.

By forming the baby backpack sack 21 out of a single piece of material 23, a considerable savings in assembly time and materials is realized. Also, by arranging the longitudinal edges in the form of an inverted Y, the baby backpack sack 21 is provided with an extra amount of room in which to expand to fit over various backpack carriers and also to receive additional supplies or other articles within the baby backpack sack 21 along with the baby.

Figure 5:
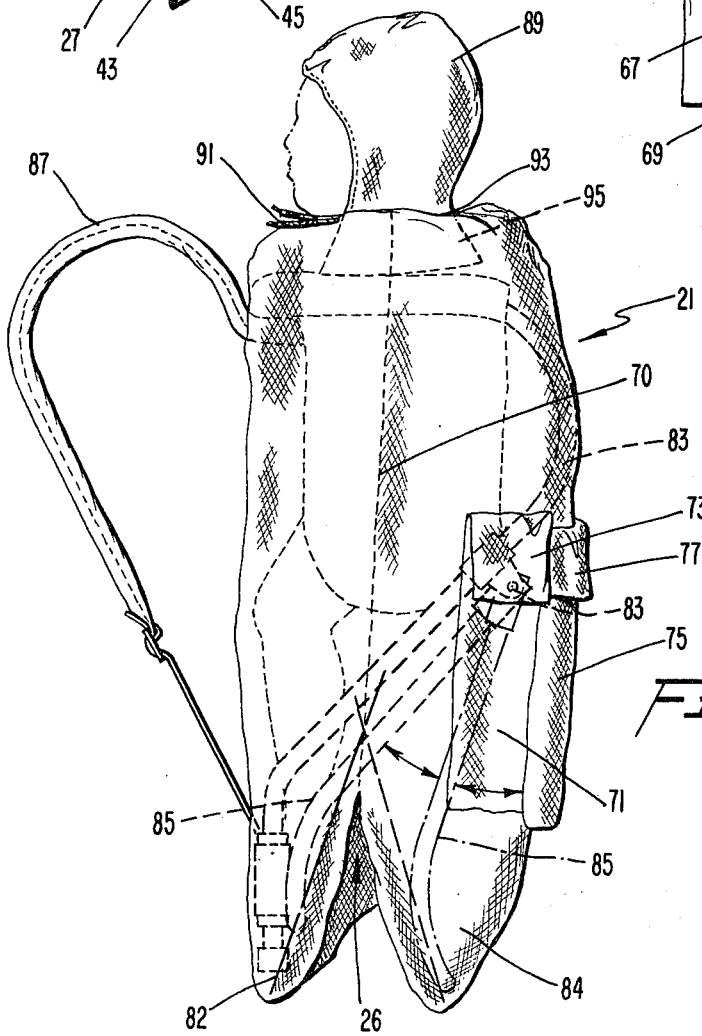
FIG. 5 is a side view of the baby backpack sack of FIG. 1.

More importantly, the inverted Y construction of the sack permits a carrier having a conventional collapsible stand arrangement to be extended while the sack is in place on the carrier (see FIG. 5). In this way, the baby may be seated in the carrier with the stand extended without having to first remove the sack 21. Accordingly, the baby and carrier may be removed from the wearer's back as on a hike and remain comfortable and protected from the elements in a convenient manner. The inverted Y shaped construction of the longitudinal edges of the baby backpack sack 21 permits the necessary extra expansion of the sack to accommodate the extension of the stand. Also, the reinforced stitching which is preferably provided along the longitudinal edges is more easily accomplished with the arrangement of the present invention since fewer seams are required due to the unitary construction of the three panels. In addition, water and air tightness of the assembled backpack sack 21 is improved due to the minimum number of seams employed.

Preferably, arranged on the third panel 37 (or the back side of the baby backpack sack 21) are a plurality of pockets. Two smaller pockets 71 having tucks in the longitudinal edges thereof to permit expansion of the pockets 71 are particularly suited for receiving bottles or the like when using the baby backpack sack 21 of the present invention. The pockets 71 have reclosable flaps 73 which may be secured to the body of the pockets 71 by any suitable fastener such as conventionally known Velcro strips. A larger central pocket 75 having tucks in the longitudinal edges to permit expansion is particularly adapted for carrying diapers and the like and also contains a reclosable top flap 77.

With reference to FIG. 3, a Velcro strip 79 is provided on the reclosable flap 77 and on the surface of the pocket 75. When the reclosable flap 77 of the central pocket 75 is opened, an elongated opening 81 provided in the third panel 37 of the baby backpack sack 21 is accessible. The opening 81 provides easy access to the interior of the baby backpack sack 21 when the baby is placed in the backpack sack 21 and the drawstring 53 has been pulled snugly around the baby to protect the baby from foul weather. In this way, items contained within the baby backpack sack 21 can be obtained without disturbing the sealed closure at the top of the baby backpack sack 21. Also, the opening 81 facilitates readjustment of the feet or other parts of the baby after the baby has been placed on the backpack carrier within the baby backpack sack 21. It should be noted, that the reclosable flap 77 of the pocket 75 also serves to prevent moisture and other materials from entering the opening 81 when the flap 77 is closed.

With reference again to FIG. 5, the baby backpack sack 21 is arranged over a baby backpack carrier having a frame 83 (indicated in phantom lines). The frame 83 includes a collapsible stand including a pivotable bar 85 which pivots about an axis 86. The bar 85 is used to support the backpack carrier when it is desired to set the baby down or to facilitate putting the baby within the backpack carrier. It should be noted that, as illustrated in FIG. 5, the stand bar 85 is pivoted to an inoperative position and shown in place immediately adjacent the frame 83. If desired, the stand bar 85 may be maintained in an outer portion 84 of the sack. Alternatively, the stand bar 85 may be received within an inner portion 82 of the sack. It should be noted, however, that movement of the stand bar 85 from the inner portion 82 of the sack to the outer portion 84 of the sack may be obstructed by the panel 26 if the stand bar 85 is sufficiently long (without first removing the sack from the carrier). It may be preferable, however, to arrange the stand bar 85 in the inner portion 82 to provide more storage room in the outer portion 84 especially if it is not anticipated that the stand bar 85 will be extended to the useful position.

It is to be understood, however, that due to the expandable construction of the baby backpack sack 21 provided by the inverted Y shaped longitudinal edges that the stand bar 85 could be pivoted rearwardly of the baby backpack carrier into the baby backpack sack 21 such that the stand bar 85 could be used to support the carrier even with the baby backpack sack 21 disposed over the frame 83. In this way, the lower portion of the sack has a greater maximum cross section than an upper portion of the sack so as to accomodate the extended stand bar 85. This arrangement is advantageous since, as stated above, the stand bar 85 provides a simple apparatus for maintaining the baby in the carrier in an upright position when it is not desired to maintain the carrier on the back and also permits easier placement of the baby within the baby backpack sack 21 surrounding the frame 83.

When the sack 21 is in place on a baby carrier, an upper portion of a pair of shoulder straps 87 extend outwardly from the first panel 25 of the baby backpack sack 21 through the slot 57 underneath the releasably fastened flap 59. Also, a lower portion of the shoulder straps 87 extend through slits made within the reinforcements 67 on the first panel 25 of the baby backpack sack 21. It should be noted that the particular backpack carrier shown in FIG. 5 is for purposes of illustration only. Any one of a number of commercially available baby backpack carriers can be used with the baby backpack sack 21 of the present invention. In such a case, additional or different slits may be required within the reinforcements 69 arranged generally on the first panel 25 of the baby backpack sack 21. Also, a different arrangement of the shoulder straps through the releasable fasteners 61 may be required as discussed previously.

A hood 89 is preferably provided for enclosing the baby's head (FIGS. 1 and 5). The hood 89 preferably includes a drawstring 91 which encircles a portion 93 of the hood 89 which portion 93 is adapted to surround the face of a baby. The hood 89 also includes a wide collar portion 95 arranged along a lower edge of the hood 89. The wide collar portion 95 is provided to more completely cover the neck and shoulders of the baby when the baby is arranged within the baby backpack sack 21. In other words, during foul weather, the baby is placed within the baby backpack sack 21 and the hood 89 is placed over the baby's head. The drawstring 93 on the hood is then tightened about the baby's face and the drawstring 53 (along the edge area 51 of the baby backpack sack 21) can be tightened snugly about the hood 89 above the enlarged collar portion 95 to present a substantially waterproof seal around the head of the baby.

When preparing to use the baby backpack sack 21 of the present invention, the buckles or stitching of the shoulder straps of the baby backpack carrier are disconnected to release the straps from the frame 83. Appropriate slits are then cut (if this has not already been done) in the first panel 25 of the baby backpack sack within the appropriate reinforcements 67, 69 dependent upon the configuration and number of the staps provided on the baby backpack carrier being employed. The frame 83 of the baby backpack carrier is then slipped into the baby backpack sack 21, with or without the stand bar 85, with the opening in the backpack sack 21 arranged at the top of the backpack carrier for the baby to be placed therein. The upper portion of the shoulder straps 87 are then pulled through appropriate thirds of the slot 57 (as determined by the configuration of the straps 87) in the first panel of the baby backpack sack 21. The lower portion of the straps are withdrawn from within the baby backpack sack 21 or are inserted through the appropriate opened slits within the reinforcements 67, 69 dependent again on the configuration of the particular carrier. The lower portion of the shoulder straps are buckled to the upper portion or secured to the baby backpack frame 83 as appropriate. The baby can then be placed within the baby backpack sack 21 and onto the frame 83 of the baby backpack carrier in the usual manner. Any adjustment which may be necessary to the baby backpack sack 21 to accommodate the stand bar 85 or to position the feet of the baby can be made by opening the reclosable flap 77 and placing the hands through the opening 81 provided within the larger pocket 75. The hood 89, which may be stored in the larger pocket 75, may then be placed on the baby's head if desired and the drawstring 53 at the open end of the baby backpack sack 21 can be secured around the baby. It is to be noted that the sack 21 can be secured around the baby either at the neck (with the baby's hands within the sack) or around the baby's waist (with the baby's hands out of the sack).

In the preferred embodiment, the baby backpack sack 21 is constructed of coated nylon and has a width of 22.5 inches. Since the nylon material comes in rolls 45 inches wide, two baby backpack sacks can be conveniently cut side by side out of a single width of material. In this way, a minimum amount of material is wasted. Also in the preferred embodiment, the drawstrings 53, 93 are each made of nylon to facilitate a sliding of the drawstrings within the nylon material.

The baby backpack sack of the present invention provides a simple and efficient covering for a backpack carrier which can protect a baby from the elements and keep him/her warmer than the normal backpack carrier. Further, the present invention provides a baby backpack sack which is convenient to use due to the large expandable pockets arranged on the outside of the baby backpack case and the access slot provided for easy access to the interior of the baby backpack sack even when a baby is placed within the backpack sack. The present invention also provides a baby backpack sack which is simple in construction but is readily adaptable to a large number of presently manufactured baby backpack carriers. Still further, the present invention provides a baby backpack sack which is large enough to permit the user to carry other baby items or any other items which are desired due in part to the inverted Y shaped longitudinal edges. Finally, the present invention provides a baby backpack sack configured so as to accommodate a baby carrier having a collapsible stand in both a collapsed and extended arrangement.

The principles and preferred embodiment of the present invention have been described in the foregoing specification. However, the invention which is intended to be protected is not to be construed as limited to the particular embodiment disclosed. The embodiment is to be regarded as illustrative rather than restrictive. Variations and changes may be made by others without departing from the spirit of the present invention. Accordingly, it is expressly intended that all such variations and changes which fall within the spirit and scope of the present invention as defined in the appended claims be embraced thereby.

What is claimed is:

1. A baby backpack sack adapted to substantially completely enclose a backpack carrier having shoulder straps, comprising:

a first generally rectangular panel defining a first side of the sack, said first panel having an upper edge, a lower edge and first and second side edges;

a second generally rectangular panel defining a second side of the sack, said second panel having an upper edge, a lower edge, said first and second side edges, with said first panel and said second panel being joined to one another along only a portion of said first side edges and said second side edges;

a third generally rectangular panel defining a bottom of said sack, said third panel having a first lower edge, a second lower edge and first and second side edges, said third panel being joined along said first lower edge to said lower edge of said first panel, said third panel being joined along said second lower edge to said lower edge of said second panel, said third panel being joined along a portion of said first side edge to the remainder of said first side edge of said first panel and being joined along the remainder of said first side edge to the remainder of said first side edge of said second panel and said third panel being joined along a portion of said second side edge to the remainder of said second side edge of said first panel and being joined along the remainder of said second side edge to the remainder of said second side edge of said second panel; and means for facilitating passage of said shoulder straps of said backpack carrier through said first panel.

2. The baby backpack sack of claim 1 wherein said first, second and third panels are formed of a continuous piece of flexible material.

3. The baby backpack sack of claim 1 wherein said means for facilitating passage includes an elongate slot provided on said first panel, said elongate slot having means for dividing said elongate slot into three generally equal portions.

4. The baby backpack sack of claim 3 wherein said means for facilitating passage further includes a plurality of slots provided adjacent said lower edge of said first panel.

5. The baby backpack sack of claim 4 wherein said means for facilitating passage further includes means for reinforcing said plurality of slots provided adjacent said lower edge of said first panel.

6. The baby backpack sack of claim 3 wherein said means for facilitating passage further includes reinforcement means for defining intended slots adjacent said lower edge of said first panel.

7. The baby backpack sack of claim 1 further comprising pocket means for providing storage compartments in said sack, said pocket means being provided on said second panel.

8. The baby backpack sack of claim 7 wherein said pocket means includes a selectively closable slot providing access to an interior of said sack.

9. The baby backpack sack of claim 1 further comprising drawstring means for selectively closing an upper end of said sack.

10. The baby backpack sack of claim 9 further comprising a hood adapted to be received about a head of a baby, said hood having a drawstring around an open face portion of the hood and an enlarged collar portion extending outwardly along substantially an entire circumference of an edge of the hood, said enlarged collar portion being receivable within said upper end of said sack to selectively seal said hood relative to said sack.

11. In a baby carrier having a seat for receiving a baby, shoulder straps for supporting the seat on a wearer's back and collapsible stand means for selectively maintaining said seat in an upright configuration when said stand means is extended, the improvement comprising a baby backpack sack adapted to be received over both the seat of the baby carrier and said collapsible stand means to substantially completely enclose the carrier, the sack having means for facilitating passage of said shoulder straps through a wall of said sack, means for releasably closing a normally open end of said sack securely about said baby, a lower portion of said sack being readily expandable such that a maximum cross section of the lower portion is greater than a maximum cross section of an upper portion of said sack to accommodate said collapsible stand means when extended within the lower portion of said sack.

12. A baby backpack sack adapted to substantially completely enclose a baby backpack carrier comprising:

a flexible sack having a normally open upper end, closed sides and a closed lower end;

means for selectively, partially closing the open end;

first means for facilitating passage of a lower portion of shoulder straps of the baby backpack carrier through said sack;

a slot in a first side of the sack arranged centrally near the open end of the sack adapted for selectively receiving an upper portion of the shoulder straps attached to the baby backpack carrier; and said lower end of said sack being readily expandable such that a maximum cross section of said lower end is substantially greater than a maximum cross section of said upper end.

13. The baby sack of claim 12 further comprising an opening for permitting access to the inside of the container arranged on a second side of the container.

14. The baby sack of claim 12 wherein the sack is formed by a single, continuous piece of material joined together along first and second seams, said material being divided by first and second fold lines into a first side panel, a second side panel and a bottom panel, each of said seams both joining portions of said first and second side panels together and joining the remainder of said first and second side panels to separate portions of said bottom panel, said first side being connected to said bottom panel along said first fold line and the second side being connected to said bottom panel along said second fold line.

15. A baby backpack sack adapted to substantially completely enclose a baby backpack carrier having shoulder straps, comprising:

a first panel defining a first side of the sack;

a second panel defining a second side of the sack;

a third panel defining a bottom of said sack;

means for joining said panels together to define a sack normally open at an upper end, a lower end of said sack being readily expandable such that a maximum cross section of the lower end is substantially greater than a maximum cross section of said upper end; and means for facilitating passage of said shoulder straps through said sack.

* * * * *